US007455012B2

(12) United States Patent
Murphy

(10) Patent No.: US 7,455,012 B2
(45) Date of Patent: Nov. 25, 2008

(54) RUBBER STAMP PACKAGE

(76) Inventor: Joseph R. Murphy, 75 Thornbush Road, Wethersfield, CT (US) 06109

( * ) Notice: Subject to any disclaimer, the term of this patent is extended or adjusted under 35 U.S.C. 154(b) by 549 days.

(21) Appl. No.: 11/249,590

(22) Filed: Oct. 12, 2005

(65) Prior Publication Data

US 2007/0079716 A1 Apr. 12, 2007

(51) Int. Cl.
*B41K 1/58* (2006.01)

(52) U.S. Cl. ..... 101/327; 101/333; 101/405

(58) Field of Classification Search ..... 101/327, 101/333, 405, 406; 206/461, 470, 471, 485, 206/486; *B41K 1/58*
See application file for complete search history.

(56) References Cited

U.S. PATENT DOCUMENTS

| | | | | |
|---|---|---|---|---|
| 680,658 | A | 8/1901 | Hastings | |
| 830,188 | A * | 9/1906 | Sternau | 101/333 |
| 1,237,538 | A * | 8/1917 | Michaud | 101/333 |
| 1,516,960 | A | 11/1924 | Faggen | |
| D197,862 | S | 3/1964 | Wills et al. | |
| 3,311,227 | A | 3/1967 | David et al. | |
| 3,645,384 | A | 2/1972 | Wind | |
| D240,200 | S | 6/1976 | Lyon | |
| 4,375,191 | A | 3/1983 | Dickey | |
| 4,708,817 | A | 11/1987 | Dudnick | |
| D294,123 | S | 2/1988 | Hill | |
| D306,404 | S | 3/1990 | Hill | |
| D363,021 | S | 10/1995 | Lombard | |
| D365,984 | S | 1/1996 | Hofmann | |
| 5,505,130 | A | 4/1996 | Winston | |
| 5,549,204 | A | 8/1996 | Toren | |
| 5,636,569 | A | 6/1997 | Winston | |
| D399,134 | S | 10/1998 | Lidle | |
| 5,826,515 | A * | 10/1998 | Frable et al. | 101/483 |
| 5,865,305 | A | 2/1999 | Yasoshima | |
| 6,039,495 | A | 3/2000 | Zimmerman et al. | |
| 6,231,906 | B1 | 5/2001 | Alessi | |
| D506,397 | S | 6/2005 | Hall | |
| 2005/0098452 | A1 | 5/2005 | Weisberg | |

* cited by examiner

*Primary Examiner*—Leslie J Evanisko

(57) ABSTRACT

A rubber stamp package includes a multiplicity of rubber stamps each having a body of circular cross section, a flexible stamp indicium on one surface thereof, and a handle on the other surface thereof, with a free end of the handle being of dome-shaped configuration. A synthetic resin container stores the stamps and has a base section with a multiplicity of spaced circular recesses seating the body of the stamps and a cooperatively dimensioned and configured cover section having a complementary pattern of generally spherical recesses for seating the free ends of the stamp handles. The container sections are releasably held in a closed relationship by interengaging elements.

8 Claims, 6 Drawing Sheets

RUBBER STAMP PACKAGE

BACKGROUND OF THE INVENTION

The present invention relates to rubber stamps, and, more particularly, to a package in which the rubber stamps are readily stored.

Rubber stamps are among the favorite toys for children who enjoy using the stamps to imprint letters, symbols, etc. on various materials, often to the consternation of their parents. Since these stamps will retain ink on their surface; the child may have residual ink in or on the indicium so that it is desirable to store the stamps in a segregated fashion and in a manner so that they will not come into contact with clothing, furniture, etc.

Since a child may have several sets of stamps with differing indicia, it is also desirable to have the rubber stamps stored in a fashion so that the child can readily extract the stamp collection with the desired indicia from a toy box, shelf or other storage location.

It is an object of the present invention to provide a novel package in which the individual ink stamps are stored and from which the child can readily extract the desired stamp(s).

It is also an object to provide such a package which can be easily and economically formed from transparent synthetic resin sheet material.

Another object is to provide such a package which can also function as another attractive point-of-purchase display.

SUMMARY OF THE INVENTION

A rubber stamp package comprises a multiplicity of rubber stamps each having a body of circular cross section, a flexible stamp indicium on one surface thereof, and a handle on the other surface thereof. The free end of the handle is of dome-shaped configuration.

A synthetic resin container storing the stamps has a base section with a base, side and end walls. The base wall has a multiplicity of spaced circular recesses seating the body of the stamps and a cooperatively dimensioned and configured cover section with top, side and end walls. The top wall has a complementary pattern of generally spherical recesses for seating the free ends of the stamp handles, and releasable means engages the container sections in a closed relationship. The container sections being cooperatively dimensioned and configured to seat the stamps.

In one embodiment, the base and cover sections are of generally rectangular configuration and are joined by an integral hinge along one of the side and end walls thereof. The base and cover sections have interengaging retention elements to hold the sections in a releasably closed position.

Preferably, the circular recesses are defined by arcuate surfaces on spacer elements formed on the base wall and on the side and end walls of the base section. One of the sections has a flange extending about the side and end walls thereof providing a channel-shaped recess and the other of the sections has a flange extending along the side and end walls, the flange of the other section seating in the channel of the one section. The releasable engaging means comprises a detent on one of the sections and a recess on the other of the sections in which the detent is engaged.

DETAILED DESCRIPTION OF THE ILLUSTRATED EMBODIMENT

Figure 1:
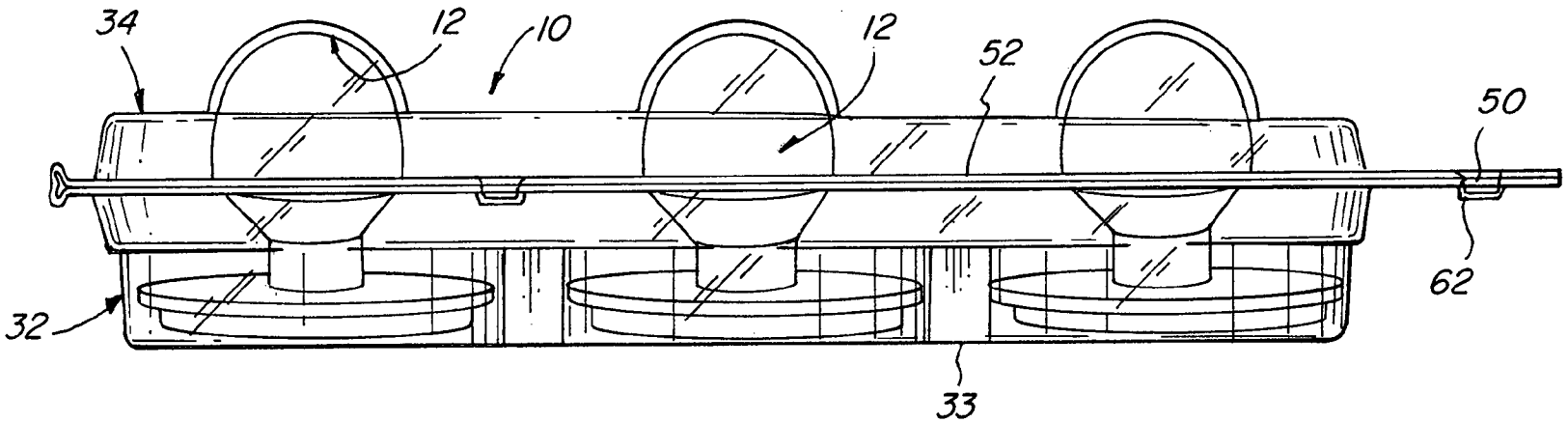
FIG. 1 is a cross sectional view of a rubber stamp package embodying the present invention.
Figure 2:
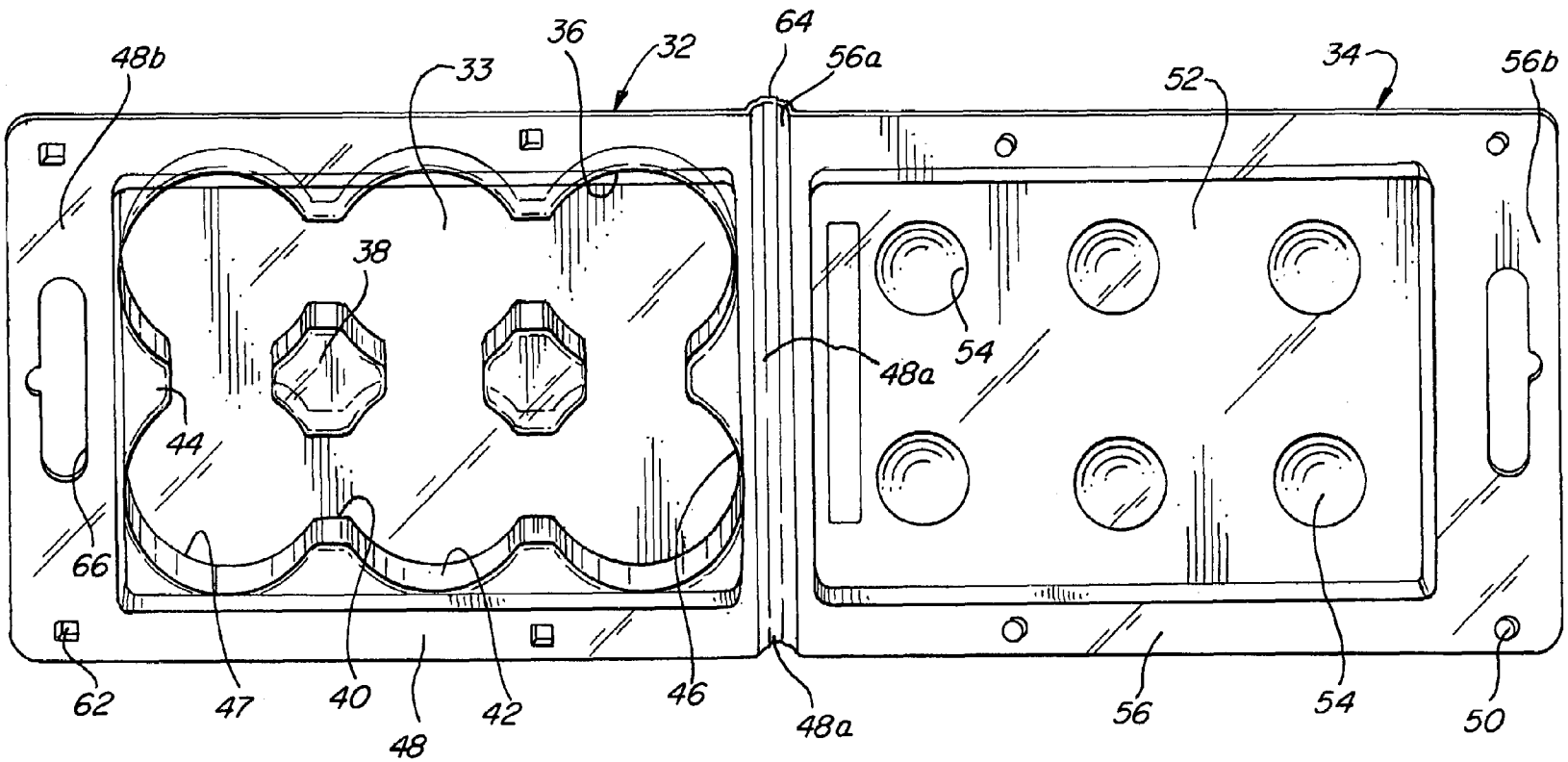
FIG. 2 is a plan view of the open container used in the package of FIG. 1.

Turning first to FIGS. 1 and 2, a package embodying the present invention comprises an integrally formed transparent synthetic resin container generally designated by the numeral 10 and a multiplicity of rubber stamps generally designated by the numeral 12.

Figure 3:
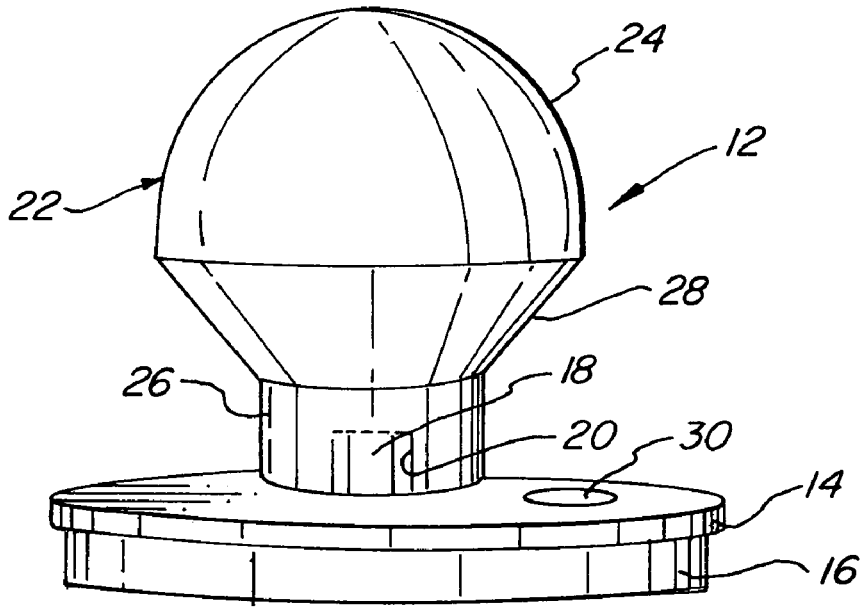
FIG. 3 is an elevational view of a rubber stamp.

As best seen in FIG. 3, the rubber stamps 12 each have a transparent disc shaped body 14 on the lower surface of which is an indicium 16 upon which ink will deposit when pressed against an ink pad. On the upper surface of the body 14 is a cylindrical formation 18 which is adhesively engaged in a cooperatively configured recess 20 formed in the lower end of the integrally formed handle 22 which has a dome shaped upper grip portion 24, a cylindrical base portion 26 and an intermediate frustoconical portion 28. On the upper surface of the disc is an indicium 30 which replicates the outline of the indicium 16 on the bottom surface.

As seen in FIGS. 1 and 2, the container 10 is integrally formed from transparent synthetic resin with a base section generally designated by the numeral 32 and a cover section generally designated by the numeral 34. The base section 32 is formed with a base wall 33, side walls 42 and end walls 46. The base wall 33 has six cylindrical recesses 36 with two inner multilobed spacers 38 disposed between the three pairs of recesses 36, a pair of side spacers 40 on each side wall 42 and a single end spacer 44 on each end wall 46. Corner spacers 47 are formed at each of the corners. The spacers 38, 40, 44 and 47 have arcuate side faces which cooperate to define the cylindrical recesses 36 in which the disc shaped body 14 of the rubber stamps 12 are seated. Extending about the upper end of the side and end walls 42, 46 is a horizontal flange 48 and a pair of rectangular recesses 62 are formed in the flanges 48 along each side.

The cover section 34 has a top wall 52 formed with six dome-shaped pockets 54 which seal the dome-shaped grip portions 24. A flange 56 extends about the side and end walls 42, 46, and along the side walls 42 are a pair of detents 50 which snap into the recesses 62 to hold the cover section 34 in the closed position.

The end portions 48*a*, 56*a* of the flanges 48, 56 are joined by an integral living hinge 64. The end portions 48*b*, 56*b* of the flanges 48, 56 have aligned apertures 66 therein to enable hanging the container 10 on a hook or the like (not shown).

Figure 4:
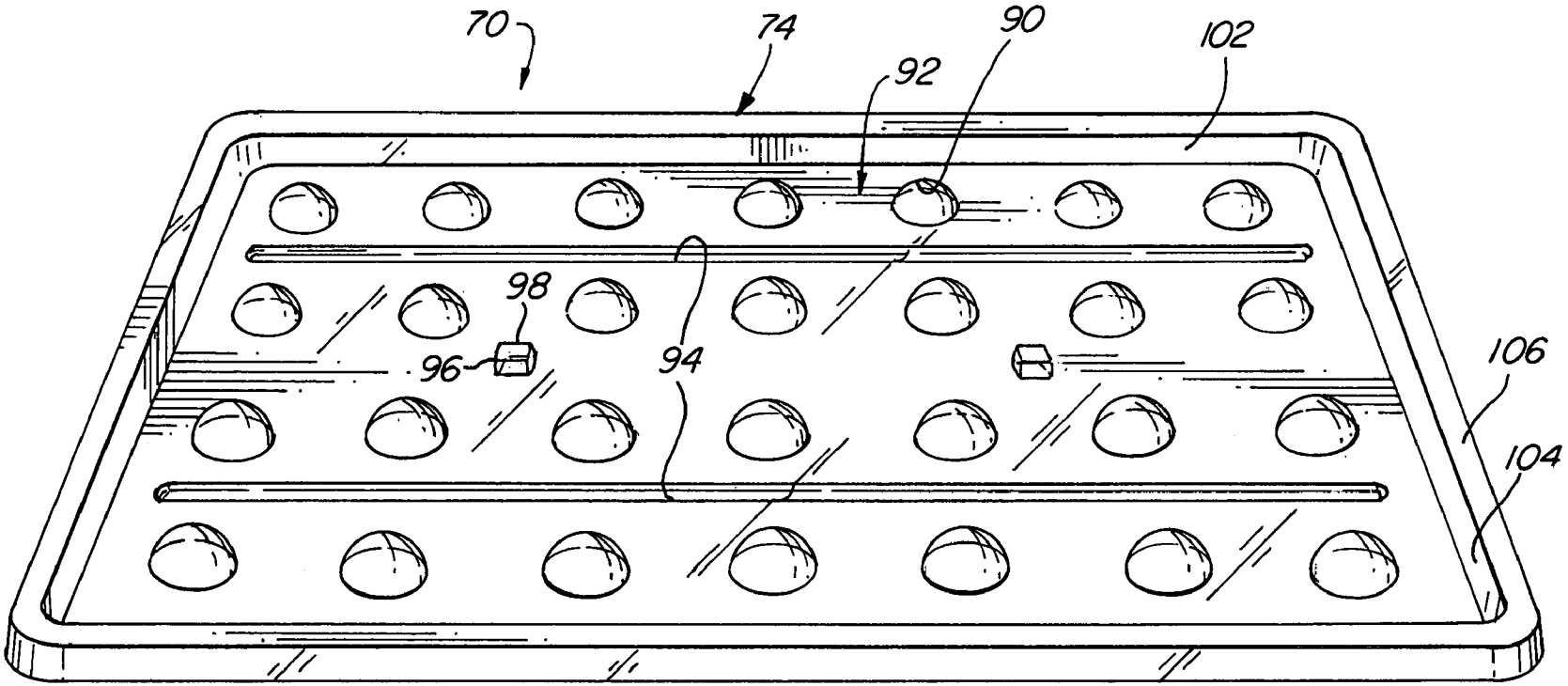
FIG. 4 is a perspective view of the cover section of a container for 28 stamps.
Figure 5:
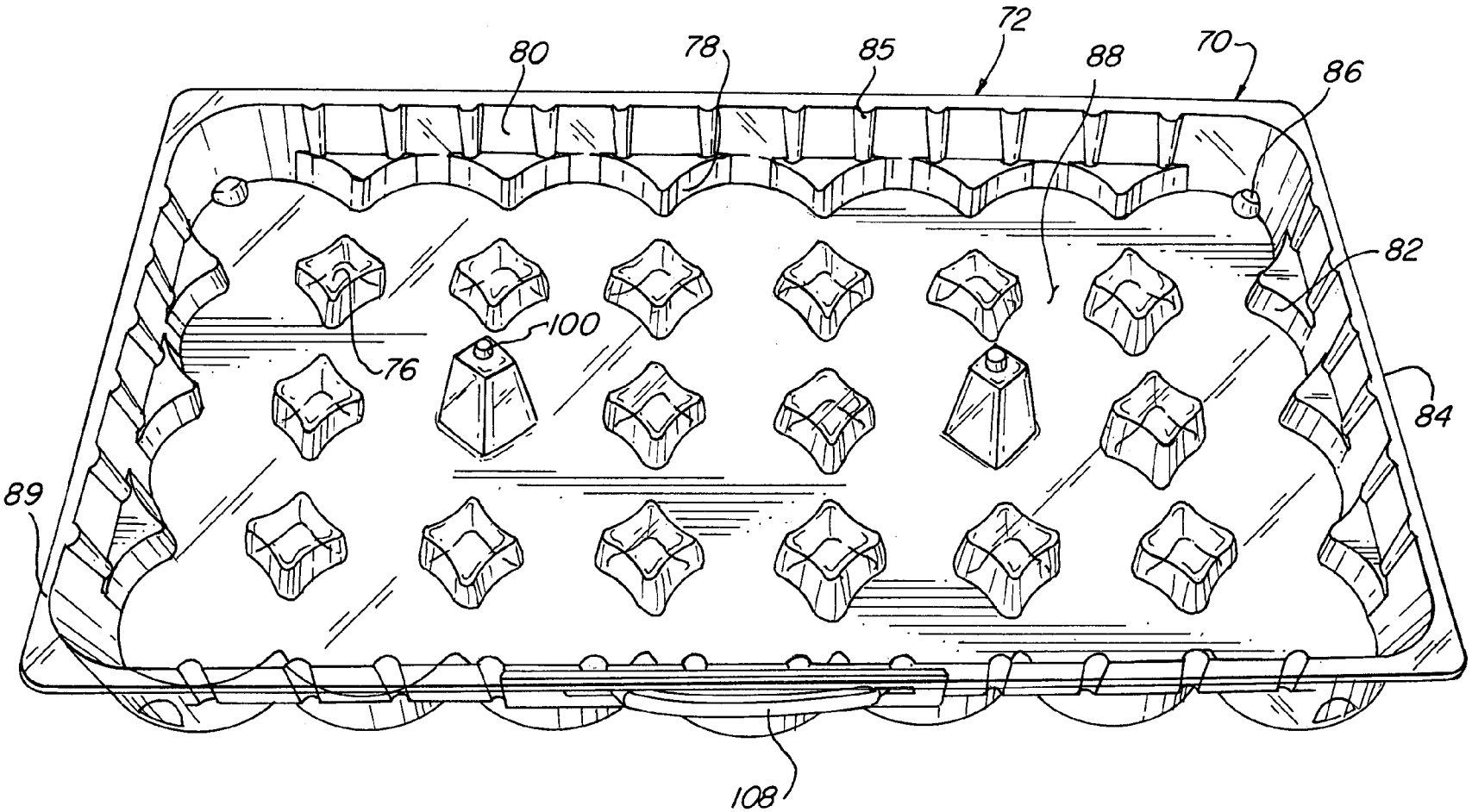
FIG. 5 is a perspective view of the base section which is configured to provide a container in combination with the cover section of FIG. 4.

Turning next to FIGS. 4 and 5, this package seats 28 stamps (not shown) in a container generally designated by the numeral 70 with a base section generally designated by the numeral 72 and a cover section generally designated by the numeral 74. The base section 72 is formed with three rows of six inner spacers 76, six side spacers 78 formed along each of the side walls 80, and three end spacers 82 formed along each of the end walls 84. Corner spacers 86 are formed at each of the corners. As in the embodiment of FIGS. 1-3, the arcuate side surfaces on the spacers 76, 78, 82 and 86 cooperate to define the cylindrical recesses 88 in which the rubber stamps are to be seated. Extending about the side and end walls 80, 84 is a horizontal flange 89. To stiffen the structure, the side and end walls 80, 84 are formed with vertically extending scallops 85.

The cover section 74 has four rows of even spherical pockets 90 formed in the top wall 92 and two longitudinally extending ribs 94 for stiffening the top wall 90. Also formed in the top wall 92 are a pair of posts 96 each providing a recess 98 into which are snap fit projections 100 on the inner spacers 76. Extending about the side and end walls 102, 104 is an inverted L-shaped flange 106 which cooperates with the side and end walls 102, 104 to form a channel into which the flange 89 of the base section 72 snap fits.

A handle strap 108 extends through apertures in the side wall 80 of the base section 72.

Figure 6:
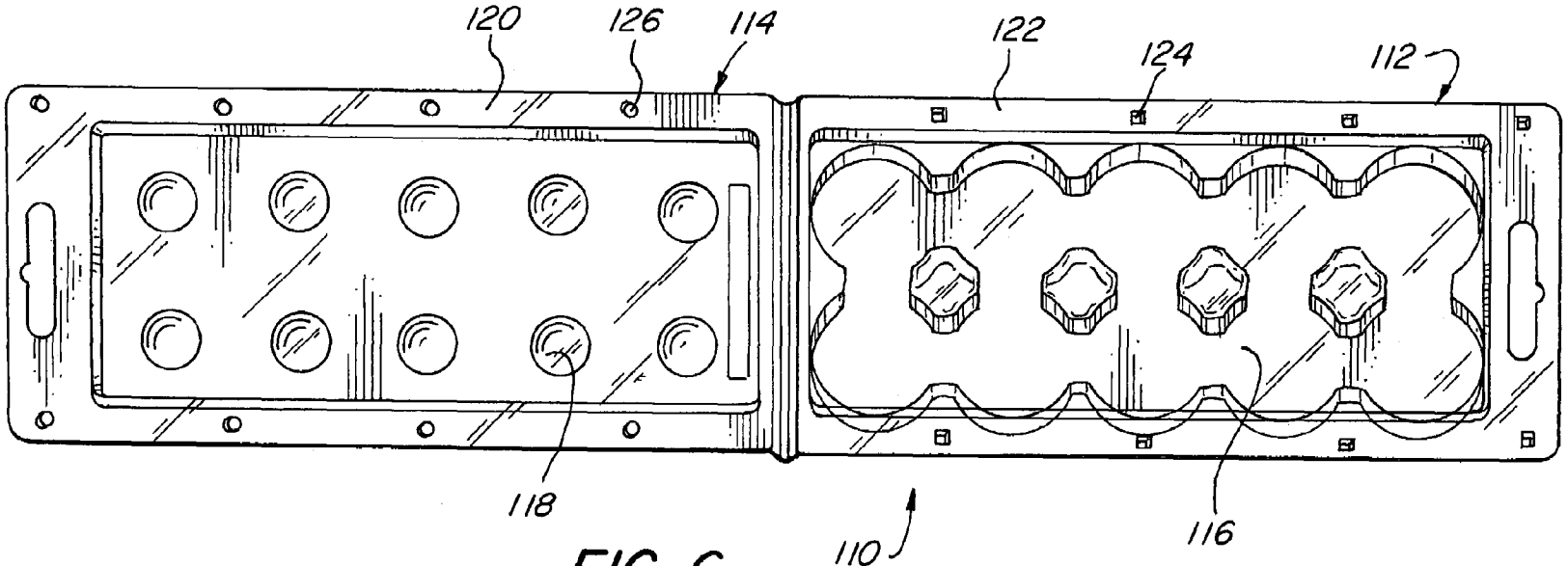
FIG. 6 is a plan view of the two elements of a package for 10 stamps.

Turning lastly to FIG. 6, therein illustrated is a container generally designated by the numeral 110 in which the base and cover sections 112, 114 are formed similarly to provide ten seating recesses 116 and pockets 118. This structure is also self-hinging and has multiple detents 124 and recesses 126 in the flanges 120, 122 which provide a snap fit action to hold the sections in closed position.

The package of the present invention allows the rubber stamps to be stored separately in a transparent package which allows the child to select the rubber stamp with the desired indicium. The package is also desirable for point-of-purchase display since the indicia can be readily seen.

Since children frequently have several different sets of rubber stamps which reflect letters, different designs, etc., the child can quickly select from a group of packages that which has the indicia which he or she desires to employ. When the package is open, the child can readily extract and return individual stamps to the recesses which are assigned to them. Since the stamps are being stored separately and can be readily removed and replaced, there is less opportunity for the rubber stamps to inadvertently come into contact with furniture, rugs, etc., so as to require cleaning of those surfaces.

The container is readily fabricated from transparent synthetic resin sheet material by conventional thermoforming techniques. The synthetic resin employed desirably has self-hinging characteristics so that the cover and base are formed and retained as a unitary structure.

Among the resins which may be employed for the container are polyvinyl chloride, polyolefins and polystyrenes. Polyvinylchloride is preferred because it combines low cost with acceptable clarity and self-hinging characteristics. The indicia are conveniently formed from an ethylene/vinyl acetate polymeric closed cell foam.

As can be seen, the two sections of the containers are readily interengaged or for storing by the snap fitting posts, detents and flanges.

Thus, it can be seen from the foregoing detailed specification and drawings that the stamp package of the present invention provides a novel transparent container in which the individual stamps are seated. The container is easily and economically fabricated.

Having thus described the invention what is claimed is:

1. A rubber stamp package comprising:

(a) a multiplicity of rubber stamps each having a body of circular cross section, a flexible stamp indicium on one surface thereof, and a handle on the other surface thereof, the free end of said handle being of dome-shaped configuration; and (b) a synthetic resin container storing said stamps and having a base section with a base, side and end walls, said base wall having a multiplicity of spaced circular recesses seating said bodies of said stamps and a cooperatively dimensioned and configured cover section with top, side and end walls, said top wall having a complementary pattern of generally spherical recesses for seating said free ends of said stamp handles, and means releasably engaging said container sections in a closed relationship, said container sections being cooperatively dimensioned and configured to seat said stamps.

2. The rubber stamp package in accordance with claim 1 wherein the base and cover sections are of generally rectangular configuration and are joined by an integral hinge along one side of said end walls thereof.

3. The rubber stamp package in accordance with claim 1 wherein said base and cover sections have interengaging retention elements to hold said sections in a releasably closed position.

4. The rubber stamp package in accordance with claim 1 wherein said circular recesses are defined by arcuate surfaces on spacer elements formed on the base, side and end walls of said base section.

5. The rubber stamp package in accordance with claim 1 wherein said one of said sections has a flange extending about the side and end walls providing a channel shaped recess and the other of said sections has a flange extending along the side and end walls, said flange of said other section seating in said channel of said one section.

6. The rubber stamp package in accordance with claim 1 wherein said releasable engaging means comprises a detent on one of said sections and a recess on the other of said sections in which said detent is engaged.

7. A rubber stamp package comprising:

(a) a multiplicity of rubber stamps each having a body of circular cross section, a flexible ink retaining stamp indicium on one surface thereof, and a handle on the other surface thereof, the free end of said handle being of dome-shaped configuration; and (b) a synthetic resin container storing said stamps and having a base section with a base, side and end walls, said base wall having a multiplicity of spaced circular recesses seating said bodies of said stamps, said circular recesses being defined by arcuate surfaces on spacer elements formed on the base, side and end walls of said base section, and a cooperatively dimensioned and configured cover section with top, side and end walls, said top wall having a complementary pattern of generally spherical recesses for seating said free ends of said stamp handles, and said base and cover sections having interengaging retention elements to hold said sections in a releasably closed position, said container sections being cooperatively dimensioned and configured to seat said stamps, said base and cover sections being of generally rectangular configuration and joined by an integral hinge along one side of said end walls thereof.

8. A rubber stamp package comprising:

(a) a multiplicity of rubber stamps each having a body of circular cross section, a flexible stamp indicium on one surface thereof, and a handle on the other surface thereof, the free end of said handle being of dome-shaped configuration; and (b) a synthetic resin container storing said stamps and having a base section with a base, side and end walls, said base wall having a multiplicity of spaced circular recesses seating said bodies of said stamps and a cooperatively dimensioned and configured cover section with top, side and end walls, said top wall having a complementary pattern of generally spherical recesses for seating said free ends of said stamp handles, said base and cover sections having interengaging retention elements to hold said sections in a releasably closed position, one of said sections having a flange extending about the side and end walls providing a channel shaped recess and the other of said sections having a flange extending along the side and end walls, said flange of said other section seating in said channel of said one section, and said container sections being cooperatively dimensioned and configured to seat said stamps.

* * * * *